US006648061B2

(12) United States Patent
Müller-Odenwald et al.

(10) Patent No.: US 6,648,061 B2
(45) Date of Patent: Nov. 18, 2003

(54) HEATING ELEMENT FOR A REGENERATIVE HEAT EXCHANGER AND METHOD FOR PRODUCING A HEATING ELEMENT

(75) Inventors: Hermann Müller-Odenwald, Mannheim (DE); Friedrich Weyland, Wiesloch (DE)

(73) Assignee: Alstom, Paris (FR)

( * ) Notice: Subject to any disclaimer, the term of this patent is extended or adjusted under 35 U.S.C. 154(b) by 0 days.

(21) Appl. No.: 10/084,133

(22) Filed: Feb. 27, 2002

(65) Prior Publication Data

US 2002/0108245 A1 Aug. 15, 2002

Related U.S. Application Data

(63) Continuation of application No. PCT/EP00/08018, filed on Aug. 17, 2000.

(30) Foreign Application Priority Data

Aug. 27, 1999 (DE) ..... 199 40 627

(51) Int. Cl.[7] ..... B23P 15/26; F28D 20/00; F28F 19/02; F28F 19/04

(52) U.S. Cl. ..... 165/10; 29/890.034; 165/133; 165/134.1; 165/905; 428/421; 428/433; 428/442; 428/335

(58) Field of Search ..... 428/421, 422, 428/433, 442, 450, 454, 335; 138/146; 165/4, 5, 133, 134.1, 8, 10, 905; 29/890.034

(56) References Cited

U.S. PATENT DOCUMENTS

| | | | | | |
|---|---|---|---|---|---|
| 4,250,215 | A | * | 2/1981 | Mayer | 206/524.3 |
| 5,036,903 | A | * | 8/1991 | Shook | 165/133 |

FOREIGN PATENT DOCUMENTS

| | | | |
|---|---|---|---|
| DE | 32 07 213 | C2 | 9/1983 |
| DE | 40 15 218 | A1 | 11/1990 |
| DE | 41 22 949 | A1 | 1/1993 |
| DE | 43 09 844 | A1 | 9/1994 |
| DE | 195 12 351 | C1 | 11/1996 |
| DE | 195 28 634 | A1 | 2/1997 |
| EP | 0 200 546 | A1 | 11/1986 |
| EP | 0 522 360 | A2 | 1/1993 |
| JP | 60 134 199 | | 7/1985 |

* cited by examiner

*Primary Examiner*—Ramsey Zacharia
(74) *Attorney, Agent, or Firm*—Arthur E. Fournier, Jr.

(57) ABSTRACT

A heating element is described for a regenerative heat exchanger that is constructed as a profiled steel sheet. The aim of the invention is to produce a heating element that is resistant to acids, has anti-soiling properties and, however, has a good thermal output. To these ends, the heating element is provided with an enameling, and a fluoroplastic coating is applied to the enameled surface.

7 Claims, No Drawings

HEATING ELEMENT FOR A REGENERATIVE HEAT EXCHANGER AND METHOD FOR PRODUCING A HEATING ELEMENT

CROSS-REFERENCE TO RELATED APPLICATION

This application is a continuation of copending International Application No. PCT/EP00/08018, filed Aug. 17, 2000, which designated the United States.

BACKGROUND OF THE INVENTION

Field of the Invention

The present invention relates to a heating element for a regenerative heat exchanger, which element is realized as a profiled steel plate.

Heating elements of this type are generally known. A plurality of heating elements form the storage mass of the regenerative heat exchanger. The storage mass that is needed for the heat transfer is under unique operational demands when utilized in corrosive and/or dust laden gas streams. For example, this applies to the storage mass on the cold side of air preheaters, where the temperature of the storage mass is at least intermittently below the dew point of sulfuric acid, and corrosive deposits form in connection with airborne dust. Similar problems arise in gas preheaters for reheating scrubbed gases from flue gas cleaners, where not only acids and dust but also sorption or neutralization agents and products from the flue gas cleaning plant deposit on the heating surfaces. The storage mass must therefore be sufficiently resistant to corrosion, and the deposits should be optimally easy to wash off by blasting or flushing. Storage masses containing enameled steel plate profiles or plastic storage materials are known for such applications (see German Patent DE 32 07 213 C2 for example).

The disadvantage of enameled steel plates is that, while enamel has a good resistance to acids such as sulfuric acid and hydrochloric acid, it is not resistant to hydrofluoric acid, which occurs in flue gases, and does not withstand a basic attack for a sufficient length of time, for instance an attack due to the precipitation of neutralization agents (additives or sorption agents) for binding acidic gases. In addition, deposits adhere more or less permanently owing to the relatively good wettability of enamel. A storage material made of inexpensive plastic has held up only to a limited extent. As a result of the complex load (temperature exchange load, chemical attack), the material embrittles too rapidly and becomes damaged. Owing to the relatively low mechanical stability, it is also impossible to clean plastic storage masses with the conventional blasting or flushing pressures. Another disadvantage is the small heat storage capacity and heat conductivity of plastics, which is thermically disadvantageous and must be compensated by larger storage masses when plastics are utilized as the storage material.

In order to circumvent the embrittling and aging problems, special storage materials composed of fluorocarbon resins such as PTFE have been proposed, such as those described in German Patent DE 195 12 351 C1. Fluorocarbon resins are almost chemically inert and have the additional advantage of being particularly stain-resistant. But the material is substantially more expensive compared to enameled steel plates and cannot be economically produced in any arbitrary shape and dimension. For these reasons, the utilization of storage masses that are formed solely of fluorocarbon plastics is limited to applications as the cold-side layer with a thickness of approximately 300 mm, which necessitates additional tanks with the storage mass and therefore additional outlay for construction. Besides this, fluorocarbon plastics also have the disadvantage of having a small heat storage capacity and heat conductivity, and they are not economically feasible to produce in the profile form which is expedient for heat transfer.

SUMMARY OF THE INVENTION

It is accordingly an object of the invention to provide a heating element for a regenerative heat exchanger and a method for producing a heating element which overcome the above-mentioned disadvantages of the prior art devices and methods of this general type, which is resistant to hydrofluoric acid, has stain-resistant properties, and nevertheless exhibits a good heat storage capacity, that is to say, good heat conductivity.

With the foregoing and other objects in view there is provided, in accordance with the invention, a heating element for a regenerative heat exchanger. The heating element contains a profiled steel plate having a enameled surface, and a fluorocarbon plastic coating disposed on the enameled surface.

A corrosion guard is created by the enameling. The permeability of the fluorocarbon plastic (PTFE) is thus not so important, and a thin PTFE coating suffices. The coating guarantees the anti-adhesive properties, and it influences the heat storage capacity and heat conductivity only marginally owing to the small layer thickness.

A layer thickness between 10 and 50 $\mu$m is preferably selected, because up to this layer thickness the PTFE can be applied in one procedure.

To increase the corrosion protection, the enamel layer is implemented in an acid-resistant form.

A method for producing a heating element is characterized by the following steps:

a. steel coils are profiled with the aid of roll forming, and heating elements are cut therefrom in accordance with the required dimensions;

b. the heating element is enameled; and c. the fluorocarbon plastic is applied.

Surprisingly, it turns out that a thin layer of fluorocarbon plastic, for instance 10 to 50 $\mu$m thick, adheres sufficiently well to the enamel without any particular pretreating of the enamel surface.

For the purpose of improving the adhesion, the enamel layer can be roughened.

The fluorocarbon plastic coating can basically be realized in one or more layers.

With the heating element profiles enameled and coated with the fluorocarbon plastic, a storage mass which is corrosion-proof and stain-resistant and which does not have any thermic or structural disadvantages or any limitations with respect to operation can be produced in a particularly economical fashion. It being possible to utilize steel plate profiles which have been proven and optimized with respect to heat exchange, pressure loss and mechanical stability, whereby the thin fluorocarbon plastic layer influences the heat transfer performance only marginally (practically not at all). Another advantage of the inventive method is that the fluorocarbon plastic coating can be accomplished with the aid of the customary devices for enameling heating plates, and therefore no additional equipment is required for production.

The stain-resistant character of the inventive heating element profile reduces or even completely prevents the buildup of dirt layers that increase the pressure loss on the profiles. This brings operational advantages by making it possible to extend the intervals for the storage mass cleaning processes which are required when the maximum allowable pressure loss is reached, so that smaller amounts of waste water are generated. If deposits nevertheless form, they adhere less strongly to fluorocarbon plastic and can therefore be washed off with lower blast or flush pressure and therefore with smaller amounts of blasting medium and rinsing water.

For reasons of greater economic efficiency in a boiler plant, in air preheaters an optimally low flue gas exit temperature (temperature of the flue gas after passing through the heat exchanger), and thus an optimally low cold-end temperature of the heat exchanger, is desirable. This has been limited in the case of dust laden flue gases by the excessive rapidity of deposit formation and poor washability. With the inventive stain-repellent heating plate profiles, deposit formation given an extreme temperature drop far below the dew point is hindered or at least more manageable, which ultimately allows a more effective lowering of the flue gas temperature. A lower flue gas temperature results in a higher boiler effectiveness and therefore a lower level of $CO_2$ emissions, and the equipment that is connected to the air preheater on the downstream side (electrofilters, flue gas cleaning systems) can be built smaller.

In regenerative heat exchangers for systems for selectively reducing nitrogen oxides (SCR-De NOx), as well, the ammonium sulfate deposits which form on the hot layer, i.e. the middle layer, can be more easily cleaned off with the aid of the inventive coating combination.

Other features which are considered as characteristic for the invention are set forth in the appended claims.

Although the invention is described herein as embodied in a heating element for a regenerative heat exchanger and a method for producing a heating element, it is nevertheless not intended to be limited to the details described, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments.

DESCRIPTION OF THE PREFERRED EMBODIMENT

An exemplifying embodiment of an inventive heating element and a method for producing the heating element will now be described.

A heating element is formed of a steel plate that is prepared for enameling by being degreased or pickled subsequent to being profiled. Following the completion of the enameling with an acid-resistant enamel, without any pretreating of the enameled surface, a fluorocarbon plastic (e.g. PTFE) is applied with a layer thickness of 10 to 50 $\mu$m, for instance by spraying, and then dried and tempered. For purposes of improving the adhesive force, the enamel surface can be roughened prior to the application of the fluorocarbon plastic coating, for instance by mild sandblasting or pickling with hydrofluoric acid or a base.

The coating can be applied in one or more layers. According to a preferred embodiment, a particularly strongly adhesive fluorocarbon resin primer is applied without pretreatment, and over that a fluorocarbon resin cover layer.

We claim:

1. A heating element for a regenerative heat exchanger, comprising:

a profiled steel plate having an enameled surface; and a fluorocarbon plastic coating disposed on said enameled surface.

2. The heating element according to claim 1, wherein said fluorocarbon plastic coating has a thickness from 10 to 50 micrometers.

3. The heating element according to claim 1, wherein said enameled surface is an acid-resistant enameled surface.

4. A method for producing a heating element for regenerative heat exchangers, which comprises the steps of:

profiling steel coils by roll forming;

cutting the heating element from the steel coils according to a required size resulting in a steel plate;

enameling the steel plate resulting in a steel plate having an enameled surface; and applying a fluorocarbon plastic coating to the steel plate.

5. The method according to claim 4, which comprises roughening the enameled surface of the steel plate.

6. The method according to claim 4, which comprises applying the fluorocarbon plastic coating in one layer.

7. The method according to claim 4, which comprises applying the fluorocarbon plastic coating in more than one layer.

* * * * *